US006705614B1

(12) United States Patent
Kyle

(10) Patent No.: US 6,705,614 B1
(45) Date of Patent: Mar. 16, 2004

(54) SLOTS IN A BOX

(76) Inventor: Rita M. Kyle, P.O. Box 280, Summersville, WV (US) 26651

( * ) Notice: Subject to any disclaimer, the term of this patent is extended or adjusted under 35 U.S.C. 154(b) by 0 days.

(21) Appl. No.: 10/252,172

(22) Filed: Sep. 23, 2002

(51) Int. Cl.[7] ..... A63F 3/00
(52) U.S. Cl. ..... 273/292; 273/274
(58) Field of Search ..... 273/274, 292, 273/269, 271

(56) References Cited

U.S. PATENT DOCUMENTS 6,093,102 A * 7/2000 Bennett ..... 463/20
6,575,466 B1 * 6/2003 Lizak

* cited by examiner

*Primary Examiner*—William M. Pierce

(57) ABSTRACT

Slots is a game in a box and is a multi-player manual slot game designed to simulate mechanical and computerized casino slot machines and computerized slot games. This game uses game tiles, chips, pay tables, and interchangeable sets of game tiles to enhance variety, vary the odds, add bonuses, and incorporate current trends. Players draw tiles face down from a pool and place them in a matrix on a tray which forms pay lines according to the game rules. The object is to match tiles along the predetermined pay lines on the pay table. The bank pays winning pay lines; the bank collects losing wagers. Allowing the players to select tile placement in predetermined rows and columns of the matrix enhances odds of winning and maintains interest. Odds of losing are controlled by placement-as-drawn in the final column or columns.

11 Claims, 4 Drawing Sheets

60

WILD WILD WILD 62 63 64

| On any Line | Chip 1 | Chip 2 | Chip 3 |
|---|---|---|---|
| WILD WILD WILD | 500 | 1500 | 3000 |
| -7- -7- -7- | 100 | 200 | 300 |
| | 30 | 60 | 90 |
| | 20 | 40 | 60 |
| | 10 | 20 | 30 |
| | 5 | 10 | 15 |
| WILD WILD | 5 | 10 | 15 |
| WILD | 2 | 4 | 6 |
| BLANK | 1 | 2 | 3 |

FIG. 7

66

67 68 69

| On any Line | Chip 1 | Chip 3 | Chip 3 |
|---|---|---|---|
| 🍒 🍒 🍒 | 500 | 1500 | 3000 |
| 7 7 7 | 100 | 200 | 300 |
| ▬▬▬ ▬▬▬ ▬▬▬ | 30 | 60 | 90 |
| ▬▬ ▬▬ ▬▬ | 20 | 40 | 60 |
| ▬ ▬ ▬ | 10 | 20 | 30 |
| — ▬▬ ▬▬▬ | 5 | 10 | 15 |
| 🍒 🍒 | 5 | 10 | 15 |
| 🍒 | 2 | 4 | 6 |

FIG. 8

SLOTS IN A BOX

FIELD OF THE INVENTION

The invention relates to the field of recreational games and more particularly to a game and method involving innovation, creativity and chance, and which requires decisions and "luck of the draw".

BACKGROUND OF THE INVENTION

Casino slot machines, personalized computer slots games and internet slots are a source of great entertainment for millions of players. The casino, internet, and personal computer slots are an individual activity. However, a manual slot game provides an opportunity for social interaction with friends and family.

Computerized or mechanical slot machines or games are programmed or geared to a certain payout. Payouts cannot be programmed into a manual game, as tile selection is random and chance.

SUMMARY OF THE INVENTION

The invention is comprised of sets or a pool of tiles marked with any imaginable depiction of any material or object to represent a group to match. (For example: bars, circles, fruits, cars, horses, cats, dogs, stars, or numbers).

Each player will have a tile collection tray which includes a matrix usually, but not limited to, three rows and three columns, and an interchangeable pay table. The tile collection tray will be filled with tiles selected in rotation from a pool of facedown tiles. Each player will have a chip rack filled with an equal number of chips. All players begin the session equal. Matching three (or more) tiles in horizontal rows, vertical, diagonal, or a non-linear path creates a pay line. Players determine by consent how many pay lines to play. Wagers must be made on each pay line and each pay line must have an equal wager.

On a basic 3×3 matrix a total of three rows, three columns, and 10 pay lines may be used. Other asymmetrical paths are possible. Players determine if the chips will be assigned a monetary value (nickel, dime, quarter, dollar, etc). The player holding the largest monetary value is determined the winner.

The players may elect not to assign a monetary value and the player holding the largest quantity of chips is the session winner. One player acts as banker, and the bank will have chips and simulated currency for "payouts." If only "quantity of chips" is used to determine the winner, then no simulated currency is used.

To keep the game fun and enjoyable, at the end of any game if any player has no chips to wager the session ends, and the player with highest value or the greatest quantity is declared the winner.

The bank never goes broke, but can give "markers" to high winners if additional chips or simulated currency are needed.

The odds of drawing a specific tile or creating a pay line will depend on the number of players and the specific playset in use. There will be adequate tiles of each to permit each player to draw a matching set. For example, if a playset is for six players, there will be at least 18 tiles of the "highest" pay set.

The strategy is to choose wisely the placement of second column tiles. The odds of winning will increase by allowing the player to chose the first two column tile placements. Reducing the number of blanks in the pool, and choice in second column placement increases the odds of win. However, controlling the placement of tiles in the third column increases the odds to lose.

The game may be ungradable with future playsets to reflect current trends in popular activities, themes, sports, and current events. Future playsets will adhere to the spirit and intent of the game.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 7 illustrates a typical pay table and the types of matches required for payouts and payout amount according to wager for matching like tiles or continuation of tiles; and FIG. 8 also illustrates another typical pay table and types of matches required for payouts and the payout amount according to wager for matching like tiles or combination of tiles.

DETAILED DESCRIPTION OF THE PREFERRED EMBODIMENTS

Figure 1:
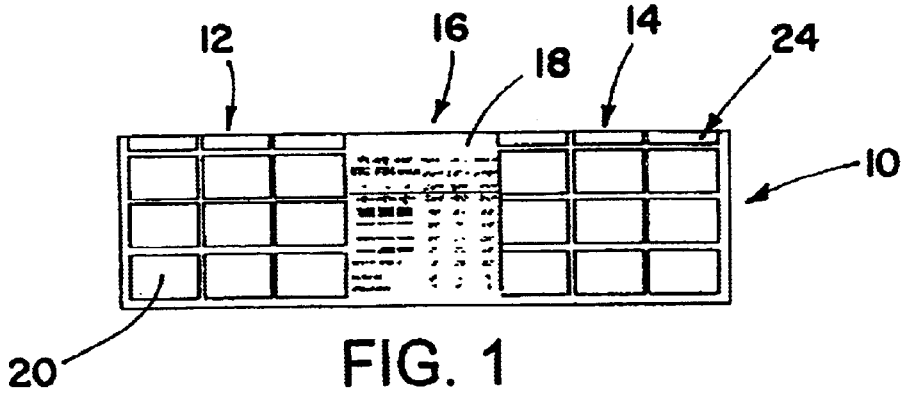
FIG. 1 illustrates a tile collection tray matrix, providing for example six rows, and six columns, and a miniature pay table in the center dividing the two matrixes.

Referring first to FIGS. 1 through 5, there is illustrated generally at 10 a tile collection tray provided to each player. The tray includes two tile holding matrixes 12 and 14 on each side of a center section 16 for holding miniature pay tables shown at 18.

Each matrix includes regularly arranged recesses 20 into which the tiles 22 (see FIG. 6) fit. In the illustrated embodiment there are nine such recesses in each matrix arranged in regular rows and columns, three on each side, top and bottom. It will be appreciated that there could be fewer or more such tile receptacles. In addition to the tile receptacle matrices on each side the top or upper edge may include recesses such as shown at 24 for wagers or placed bets.

With the nine regularly arranged tile receptacles in each matrix forming three columns (vertical) and three rows (horizontal) it is possible to provide a number of different pay lines for tile matching purposes.

Figure 2:
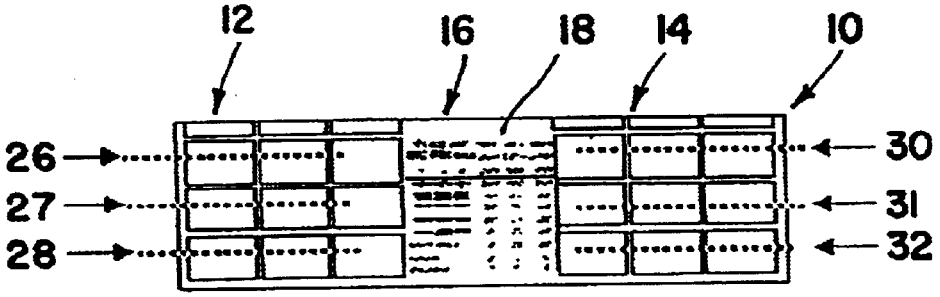
FIG. 2 is a similar view of the tile collection tray illustrating the horizontal pay lines.

Referring to FIG. 2 it will be seen that the horizontal rows of each matrix may form pay lines shown at 26, 27 and 28 for the left hand matrix, 12 and 30, 31 and 32 for the right hand matrix 14. The pay lines are shown by the dotted lines.

Figure 3:
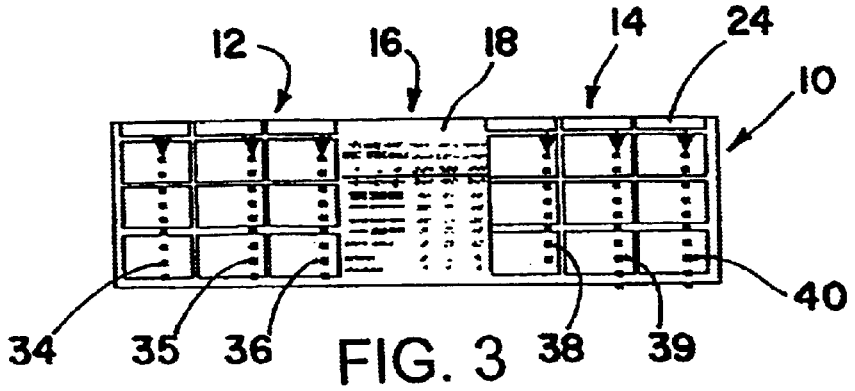
FIG. 3 is a similar view of the pay tile collection tray illustrating vertical pay lines.

As seen in FIG. 3 the three vertical columns of the left hand matrix 12 may form pay lines 34, 35 and 36 while the right hand matrix 14 may form pay lines 38, 39 and 40 from the vertical columns.

Figure 4:
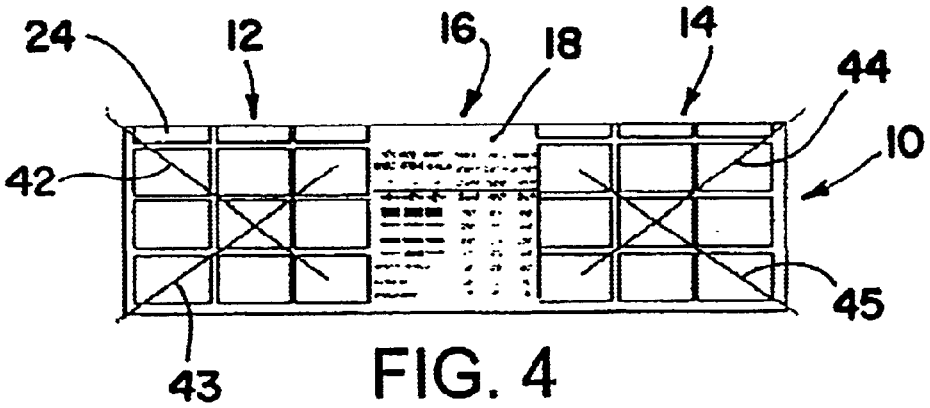
FIG. 4 is a similar view illustrating diagonal pay lines.

FIG. 4 illustrates that intersecting diagonal pay lines shown at 42 and 43 for the left hand matrix 12, and at 44 and 45 for the right hand matrix 14, may be formed with the matrixes illustrated.

Figure 5:
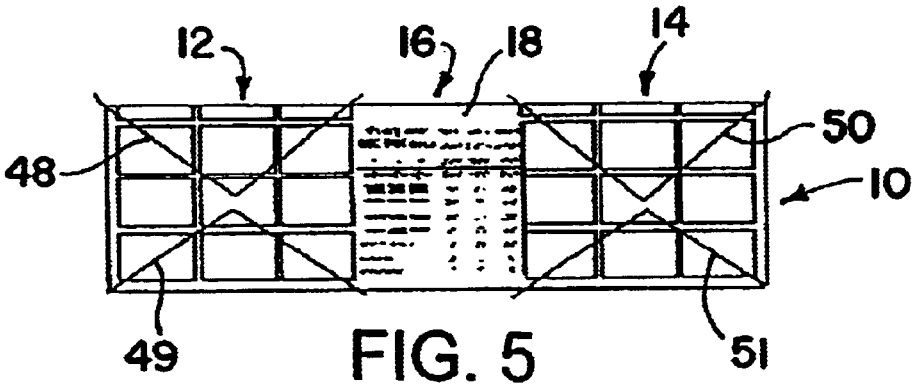
FIG. 5 is a similar view illustrating what might be called asymmetrical or non-linear pay lines.

As seen in FIG. 5 the corner tiles together with the center tile may be used to form non-linear pay lines seen at 48 and 49 for the left hand matrix 12 and at 50 and 51 for the right hand matrix 14. With nine tiles in each matrix it will be seen that as many as ten (10) different pay lines for each matrix may be formed, or a total of twenty (20) altogether.

Figure 6:
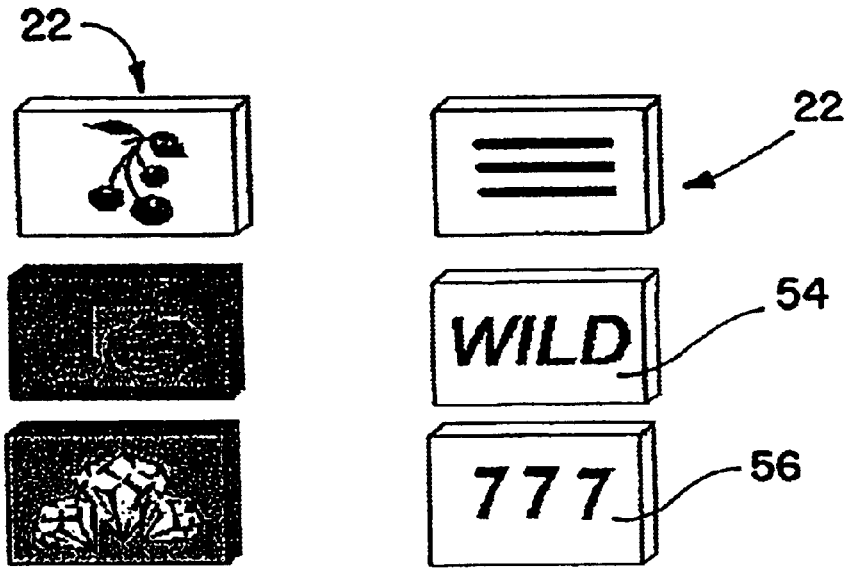
FIG. 6 is an illustration of typical play tiles illustrating examples of indicia on the face of the tiles to match on a pay line.

Referring now to FIG. 6 there is illustrated the tiles 22 which are rectangular and each having a face 54 facing the viewer provided with indicia such as shown at 56. The indicia appears on one side only so when the tile is face down either on a flat surface or in a stack, like a playing card, the indicia is not revealed.

The indicia on the face of the tile may be substantially anything imaginable. For example, it may be any material or object to represent a group to match. It may be bars, circles, fruits, cars, horses, cats, dogs, stars, numbers, blanks, and so on. The graphics may be created designs such as those created by computer graphics, alphanumeric representations, chips of various designs, materials, colors, logos, and really an endless variation. However, within the pool of tiles, say two hundred and fifty (250), for an average number of players, a number of tiles will have the same indicia or representation. Also, some of the tiles may depict an interchangeable play set such as "wild" tiles or "cherry" tiles which can be combined with other tiles to obtain a winning play line.

Referring now to FIGS. 7 and 8 there is illustrated two typical examples of pay tables. The pay table shown generally at 60 in FIG. 7 is simply a chart that illustrates what on a pay line wins and how much. The columns at the right shown at 62, 63, and 64 show the payoff range from 3000 for three (3) chips bet for three (3) wild tiles on any pay line (top of column 64) to one for a blank on any line (bottom of column 62). The payoffs are based on the odds and risks taken. The odds are determined by the number of particular tiles in the pool.

In FIG. 8 the pay table 66 shown also has these columns 67, 68, and 69, and the maximum payoff is 3000 for three cherries on any pay line to 2 for a single cherry, as seen at the top of the right hand column 69 and bottom of the left hand column 67 respectively.

In any event the selected pay table determines the payoffs. The game is provided with a substantial number of different pay tables each with different winning combinations, all of which are related to the indicia or depictions on the tiles of the pool and the number of such tiles in the pool. Several copies of each pay table may be provided and in the miniature form 18 for placement in the center 18 of each players tile collection tray.

In addition to the tile collection trays tiles and pay tables, the game will include chip racks with an equal number of chips for each player, or an equal supply of representative currency for each player. The chips and chip racks being conventional in many games aren't illustrated as is true for complete pool of tiles and all of the pay tables. Those illustrated are representational. The chips preferably have the same value although differing values may be provided as with the equal supplies of currency. The game components outlined above may be suitably packaged in a box together with instructions such as set forth below.

Although the game is designed to be played in the following described steps or variations it will be appreciated that players may literally make up their own rules to enjoy the recreational benefits of the game.

Before play begins the players will select a banker. Each player will have a tile collection tray 10 and chip rack containing equal numbers of chips. The banker will have chips, a chip rack, simulated currency and a tray 10, and display the selected pay table for the current play set or game. Players will determine the time limit or other method for conclusion of a session.

It will be apparent that the vertical pay lines seen in FIG. 3 are referred to as columns while the horizontal pay lines of FIG. 2 are referred to as rows.

In the first rotation, players determine the quantity and play the same number of pay lines. Horizontal rows should be played before the addition of other pay line paths (FIG. 2). One to six rows may be chosen for pay lines. Including vertical, asymmetrical or non-linear, and diagonal paths will increase pay lines when playing three or six rows.

All tiles in the pool are mixed or shuffled and placed face down on a playing surface. The tiles 22 may be stacked to some degree if the surface isn't large enough but will still be placed face down.

All players in the session must play the same number of pay lines. Independent of other players, each player wages an equal number of chips for each pay line. For Example, if playing six rows, six (6) chips must be wagered, one per pay line, or twelve (12) chips if two chips per pay line. Expanding pay lines by using asymmetrical or non-linear, diagonal or vertical pay lines requires an equal wager. For example: if playing six rows, including the vertical lines or columns as pay lines (FIG. 3), requires a minimum of 12 chips. After the first tile is drawn, no wagers may be withdrawn or changed.

Depending on the number of players the quantity of tiles selected at each rotation depends on the number of pay lines. For example one player may select one tile at a time, two players may select two tiles at a time, and three or more players may select three tiles at a time. Winning pay lines consist of matching tiles or a combination of tiles according to the pay tables.

First column rotation selection may be placed by a player in any position of the first or left hand column (pay line 34) on the number of rows chosen. After tiles are placed, the tiles cannot be moved. The first column rows of play must be filled before the second column rows can be placed. The second column (pay line 35) rotation begins after all players have filled the first column rows of play.

Second column rotation tiles may be placed in any horizontal row of play in the second column. Tiles must be revealed one at a time and placed. No tile can be moved after placement. Rotation continues until all players have drawn tiles to fill the second column of the rows in play.

In the final rotation(s) to fill the third column (pay line 36) of selected rows, tiles must be placed in order drawn from the pool by turning tiles one at a time. Beginning with first tile revealed, place in the third column, row 1 (26); if playing 2 rows, second tile revealed must be placed in row 2 (22); if playing 3 rows, third tile revealed must be placed in row 3 (28). Play continues in this manner until the third column of all selected rows have been filled in order revealed.

If more than three rows are selected, the first three are filled at first rotation of the third column draws, or the additional rows are filled at the next rotation.

Selection of tiles ceases when all players have completed all selected rows of the third column.

Winning combinations are identified by the player, confirmed by the banker and compared to the pay table for that game. The banker pays the winners in chips or simulated currency. Losing pay lines chips are collected by the banker. All tiles are returned to the pool face down, remixed by hand and a new game begins.

The present invention may be embodied in other specific forms without departing from its spirit, intent, or essential characteristics. The described embodiments are to be considered in all respects only as illustrative and not restrictive. The scope of the invention is, therefore, indicated by the appended Claims rather than by the forgoing description. Changes that come within the meaning and range of equivalency of the claim are to be embraced within their scope.

What is claimed is:

1. A game of slots comprising a pool of tiles each having indicia thereon on one face only, whereby when the tiles are face down the indicia is not visible, a tile collection tray for each player, each tray having at least one tile receiving matrix arranged to position the selected tiles in rows and columns, and to form selected pay lines, and a set of pay tables, with one selected for each game to indicate the matching tiles in a pay line to determine the winnings.

2. A game of slots as set forth in claim 1, wherein said matrix comprises at least nine tile receptacles arranged regularly in a square.

3. A game of slots as set forth in claim 2 including at least two matrices for each tile collection tray.

4. A game of slots as set forth in claim 3 including a pay table holder for each tray.

5. A game of slots as set forth in claim 4 wherein said pay table holder is in the center of the tray with a matrix on each side.

6. A method for playing a game of slots comprising:

providing a pool of tiles each having a face having indicia thereon, and resting said pool of tiles face down on a surface;

providing each player with a tile collection tray having a matrix of rows and columns for receiving said tiles and forming pay lines having at least three columns and rows, with an interchangeable pay table, and an equal number of chips or simulated currency;

designating a player as a banker;

players deciding by consent how many pay lines to play whereby matching a number of tiles in horizontal rows, vertical, diagonal or non-linear paths creates a pay line;

players determining the quantity and playing the same number of pay lines by placing wagers on pay lines in equal amounts;

players selecting a number of tiles from the pool of tiles with the number of tiles depending on the number of players;

players placing tiles in a first column of said matrix;

players selecting and revealing tiles from the pool of tiles one at a time and placing them in a second column of said matrix;

players selecting and revealing tiles from the pool of tiles one at a time and placing them in a third column of said matrix;

the banker comparing the selected and placed tiles of said matrix of each player to the pay table and paying winners in chips or simulated currency.

7. A method as set forth in claim 6 including the step of providing each player with a tile collection tray having more than one matrix.

8. A method as set forth in claim 6 including the step of providing each player with a pay table having two matrixes with the pay table placed between said matrixes.

9. A method as set forth in claim 6 wherein the tiles placed in said first column must be placed in consecutive rows.

10. A method as set forth in claim 9 wherein the tiles placed in said second column may be placed in any row.

11. A method as set forth in claim 10 wherein said tiles places in said third column must be placed in order in the first, second, and third rows.

* * * * *